United States Patent [19]

Bassett et al.

[11] 4,181,194

[45] Jan. 1, 1980

[54] SAFETY CLAMP DEVICE AND APPARATUS UTILIZING SAME

[75] Inventors: James H. Bassett, Redwing, Minn.; Paul L. King, Stockholm, Wis.

[73] Assignee: International Telephone and Telegraph Corporation, New York, N.Y.

[21] Appl. No.: 914,277

[22] Filed: Jun. 9, 1978

[51] Int. Cl.[2] ..... E04G 3/10

[52] U.S. Cl. ..... 182/112; 24/134 N; 182/142

[58] Field of Search ..... 182/112, 5, 142; 24/134 R, 134 N; 188/65.1, 65.2

[56] References Cited

U.S. PATENT DOCUMENTS

| | | | |
|---|---|---|---|
| D. 136,818 | 12/1943 | Paulson | 24/134 N |
| 560,708 | 5/1896 | Gorris | 24/134 N |
| 1,231,014 | 6/1917 | Goodwill | 24/134 R |
| 2,272,494 | 2/1942 | Winslow | 24/134 R |
| 3,302,750 | 2/1967 | Arnold | 182/112 |
| 3,386,530 | 6/1968 | Thompson | 182/112 |
| 3,586,125 | 6/1971 | Durand | 182/112 |

*Primary Examiner*—Reinaldo P. Machado
*Attorney, Agent, or Firm*—James B. Raden; Donald J. Lenkszus

[57] ABSTRACT

An improved safety clamp device for use with movable platforms and the like includes a body member having a safety cable receiving cradle, a lever arm having a safety cable engaging portion, the lever arm being pivotally connected to the body member and pivotally connected to an elongate bar member, and a modified bellcrank. The modified bellcrank has a first arm pivotally connected to the body member, a second arm pivotally coupled to a hoist line, and its apex pivotally connected to the elongate bar member. When the elongate bar member is in a first position relative to the body member, the safety cable engaging portion confronts but does not engage the safety cable. When the elongate bar member is in a second position relative to the body member, the safety cable engaging portion engages the safety cable thereby wedging the safety cable between the cradle and the safety cable engaging portions. The modified bellcrank and the lever arm operate cooperatively to maintain the body member and the elongate bar member in parallel relationship to the safety cable.

20 Claims, 5 Drawing Figures

SAFETY CLAMP DEVICE AND APPARATUS UTILIZING SAME

BACKGROUND OF THE INVENTION

1. Field of the Invention

This invention pertains in general to safety apparatus for movable platforms and the like and in particular to a safety clamp device adapted to be releasably mounted on an upright safety cable and affixed to a movable platform supported by a supporting hoist line whereby a supporting hoist line failure results in the load supported thereby being transferred to the safety cable. The invention also pertains to a particularly advantageous arrangement of such a safety clamp device, a movable load such as a platform, a motor drive unit and hoist and safety lines.

2. Description of the Prior Art

U.S. Pat. No. 3,386,530 issued June 4, 1968 to H. L. Thompson teaches a safety clamp device adapted to be slidably mounted on an upright safety cable and connected to a supporting hoist line which is attached to and interchangeably raises and lowers a movable platform. That safety device comprises a body member having an upright safety cable receiving cradle and a pair of spaced apart sidewalls extending outwardly therefrom. Each sidewall has an engaging edge of a predetermined length opposite the cradle. A lever arm sandwiched between the sidewalls is pivotally mounted on the body member for pivotal movement about an axis transverse to the direction of travel of the body member relative to the safety cable. The lever arm member is shiftable between a safety cable engaging position and a safety cable release position. The lever arm includes a safety cable engaging portion adapted to engage the safety cable in the safety cable engaging position. Elongate bar members are pivotally attached to the lever arm at the end opposite the safety cable engaging portion. A hoist line is attached to the upper end of the bar members and the safety platform is attached to the lower end. In the normal release position, the elongate bar members are positioned substantially upright and confront the parallel engaging edges of the sidewalls whereby the cable engaging portion of the lever arm is urged to the release position. In the event of hoist line failure, the elongate arms will shift downward thereby urging the lever arm downward and the cable engaging portion will engage the safety cable thereby clamping the safety cable against the cable receiving cradle of the body member and preventing downward movement of the safety device on the safety cable and arresting downward movement of the platform.

One disadvantage of a safety clamp device as described above is that when the movable platform is being raised or lowered, the body member may pivot and not slide parallel to the safety cable, i.e., it may on occasion cock in a non-parallel position, and therefore will not slide freely along the safety cable. Also under such conditions, wear of the safety cable or of the safety device may occur.

In a prior improvement over the safety clamp device, of U.S. Pat. No. 3,386,530, an "L" shaped member or modified bellcrank has one arm pivotally connected to the hoist line, and the apex between the two arms is pivotally connected to the elongate member and the other arm is sandwiched between the sidewalls of the body member. The other arm is allowed to slide between the sidewalls and is adapted such that its lower edge may ride on a stop pin carried by the two sidewalls.

This device also has the disadvantage that it can pivot thereby causing drag and wear. It has a further disadvantage in that the free arm of the bellcrank can improperly wedge under the stop pin. Although the two aforementioned safety clamp devices are intended for use with movable platforms, neither is particularly well adapted for use with movable platforms of the type having a hoist motor or traction drive unit mounted on the movable platform. Previously, a workman would rely on a lifeline which was fastened to his belt at one end and tied off to the building at its other end.

Other safety clamp devices are taught or shown in the following U.S. Pat. Nos. 3,006,431; 3,179,994; 3,317,971; 3,598,200; 3,852,943; Des. 180,093 and Des. 199,198. However, none of the safety clamp devices shown in these patents are adapted for use with a movable platform.

It is one object of the invention to provide an arrangement whereby a safety clamp device may be arranged in combination with a movable platform such that a workman may tie his lifeline to the movable platform with an assurance of safety.

It is another object of the invention to provide a safety clamp device which will sense tension in a support or hoist line and automatically engage a safety line when loss of tension is sensed.

It is still another object of the invention to provide a safety clamp device which does not require readjustment of the safety line each time the platform is moved.

It is a further object of the invention to provide a safety clamp device suitable for use with multiple or stacked platforms where men on lower platforms are not aided by lifelines tied to a building or other structure.

SUMMARY OF THE INVENTION

The present invention is directed to an improvement over the safety device clamp of the aforementioned U.S. Pat. No. 3,386,530.

A safety clamp device in accordance with the principles of the invention includes a body member having a safety cable receiving cradle, a lever arm pivotally connected to the body member and pivotally connected to an elongate bar member, a safety cable engaging means, and a linkage arm pivotally connected at one end to the body member and pivotally connected at its other end to the elongate bar member. When the elongate bar member is in a first position relative to the body member, the safety cable engaging means confronts but does not engage the safety cable. When the elongate bar member is in a second position relative to the body member, the safety cable engaging means engages the safety cable and the safety cable is thereby wedged between the safety cable receiving cradle and the safety cable engaging means.

In accordance with the principles of the invention, the linkage arm and the lever arm operate cooperatively to maintain the body member and the elongate bar member in substantially parallel relationships to each other for any relative positions between the body member and the elongate bar member.

In one embodiment of the invention, the linkage arm is one arm of a modified bellcrank and the pivotal connection of the linkage arm to the elongate bar member is at the apex of the modified bellcrank. The other arm of the modified bellcrank is adapted to be pivotally connected to a motor drive unit.

Further in accordance with the invention, a movable platform arrangement includes a safety clamp device having a linkage arm pivotally connected at one end to the body member and pivotally connected at the other end to an elongate bar member. The elongate bar member is connected at its lower end to a movable platform and is coupled at its upper end to a lifting means adapted to ascend and descend a hoist or lift line.

In accordance with the principles of the invention, the safety clamp device senses loss of tension in the hoist or lift line and in the event loss of tension is sensed, the safety line is engaged to prevent downward movement of the platform.

BRIEF DESCRIPTION OF THE DRAWINGS

The invention may be better understood from a reading of the detailed description taken in conjunction with the drawings in which like reference numerals designate like parts in the several views and in which.

DETAILED DESCRIPTION OF THE DRAWINGS

Figure 1:
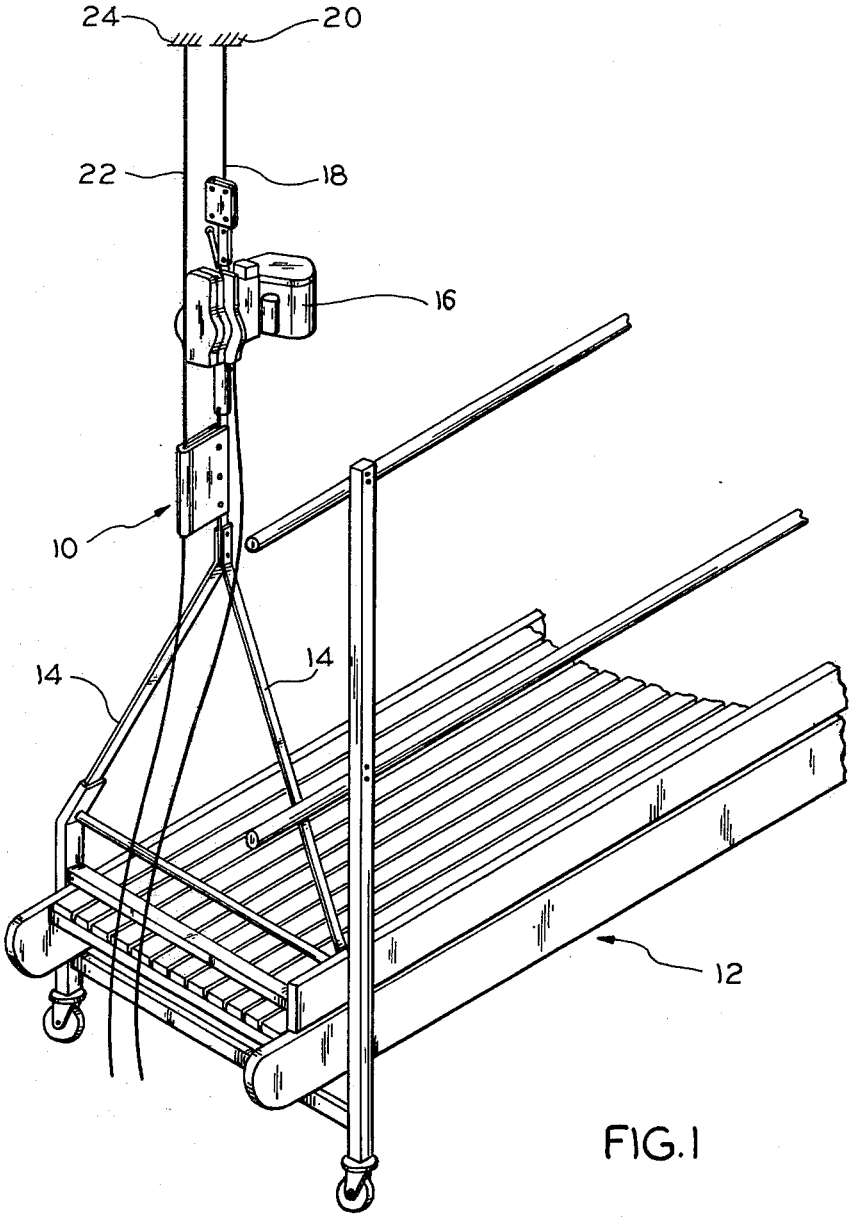
FIG. 1 is a diagrammatic view illustrating a typical usage of the platform safety device of the invention.

The safety device is indicated, in general, by numeral 10 in FIG. 1 wherein one end of a typical scaffold 12 is shown. It should be noted that the other end of the scaffold as well as the connections thereto are similar to those described below. Support bars 14 are connected at their lower ends to the scaffold body and connected at their upper ends to the safety clamp device 10. The safety device 10 is connected to the bottom of a motor driven traction drive unit 16 which climbs or descends a hoist cable 18 which in turn is connected to a cable support indicated symbolically at 20. A safety line 22 is similarly supported at one end by a cable support 24 and passes through the safety device 10.

It should be noted that although but one embodiment of the invention is shown, the safety clamp device may be advantageously employed with loads other than platforms such as bosun chairs, buckets, and general crane loads. Accordingly, the term "movable platform" is defined as including movable platforms, scaffolding, personnel and material hoists, construction tiered platforms, overhead crane loads, crane buckets and the like.

Figure 3:
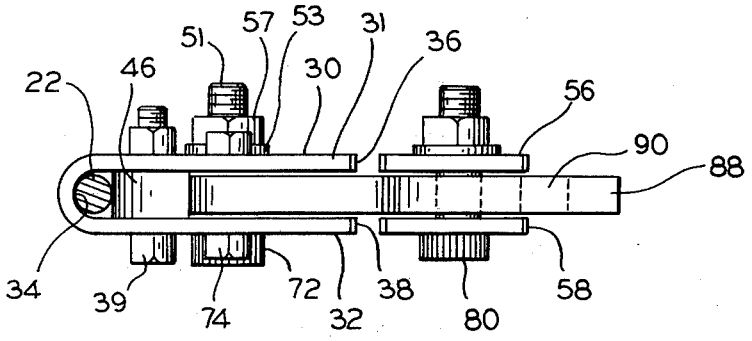
FIG. 3 is a top view of a body member of the safety device.
Figure 2:
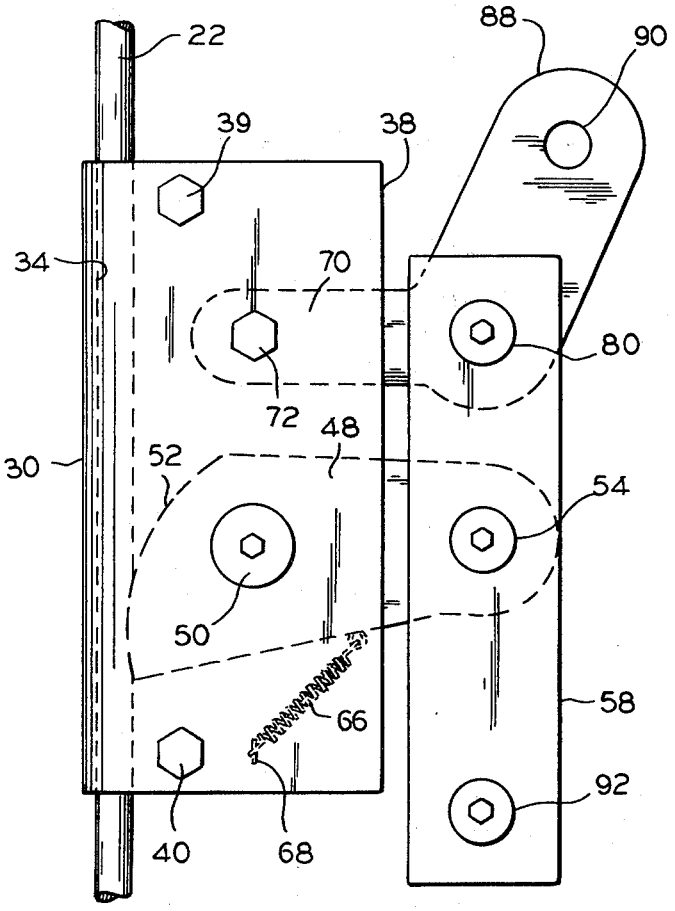
FIG. 2 is a side elevation of the safety device of the invention in a locked position after hoist line failure.
Figure 4:
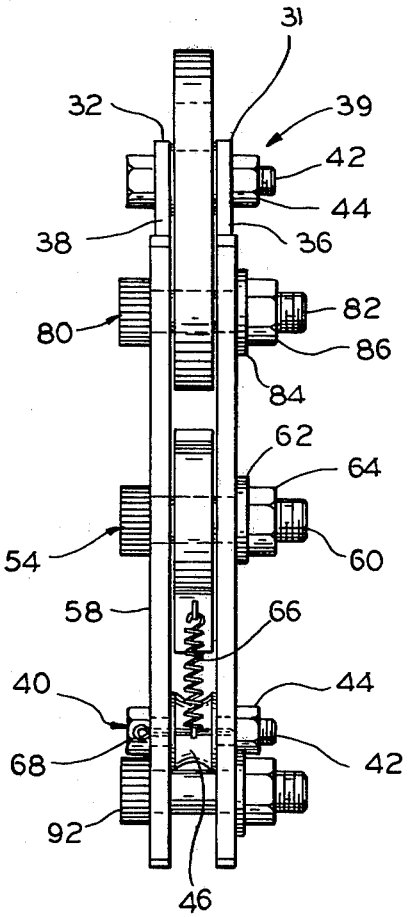
FIG. 4 is a right hand view of the safety device of FIG. 2.

Turning now to FIGS. 2, 3 and 4, the safety clamp device 10 includes a body member 30 having opposed parallel upright sides 31 and 32 spaced apart a predetermined distance and having a rectangular shape. Body member 30 further includes an upright safety cable engaging cradle 34 of substantially semi-circular transverse cross-section adapted to receive safety cable 22 for slidable movement therein. The body member is constructed from rigid steel material bent to form the safety cable engaging cradle 34. The cradle 34 is thus of integral construction with the body member 30. The body member 30 further includes a pair of substantially upright parallel bar engaging edges 36 and 38 positioned on sides 31 and 32, respectively. The body member 30 includes two pairs of apertures, each pair positioned therein in registry, between the edge portions 36 and 38 and the upright cradle portion 34. One pair of the apertures is disposed in the top portion of the body member 30, and the other pair of apertures is disposed in a bottom portion thereof. The upper and lower pair of apertures are adapted to receive safety cable members 39 and 40, respectively. Each safety cable guide members 39 and 40 includes a bolt guide member 42 which passes through the walls 31 and 32 transverse to the direction of travel of the body member 30 on the safety cable. The safety cable 22 is thereby retained in cradle portion 34. Each bolt guide member 42 includes a threaded bolt having a nut 44 thereon and include a roller 46 rotatably mounted on the bolt whereby the cable 22 freely passes over the rollers 46.

A lever arm member 48 is pivotally attached to body member by a shouldered bolt or lever arm body pivot member 50 which passes through apertures in the sides 31 and 32 and through an aperture in the lever arm member 48 such that the lever arm member 48 is sandwiched between the sides 31 and 32 for pivotal movement about an axis transverse to the direction of travel of the body member 30 relative to the safety cable 22. The body pivot member 50 includes a bolt 51, a washer 53 and a nut 57 threaded onto the bolt.

Figure 5:
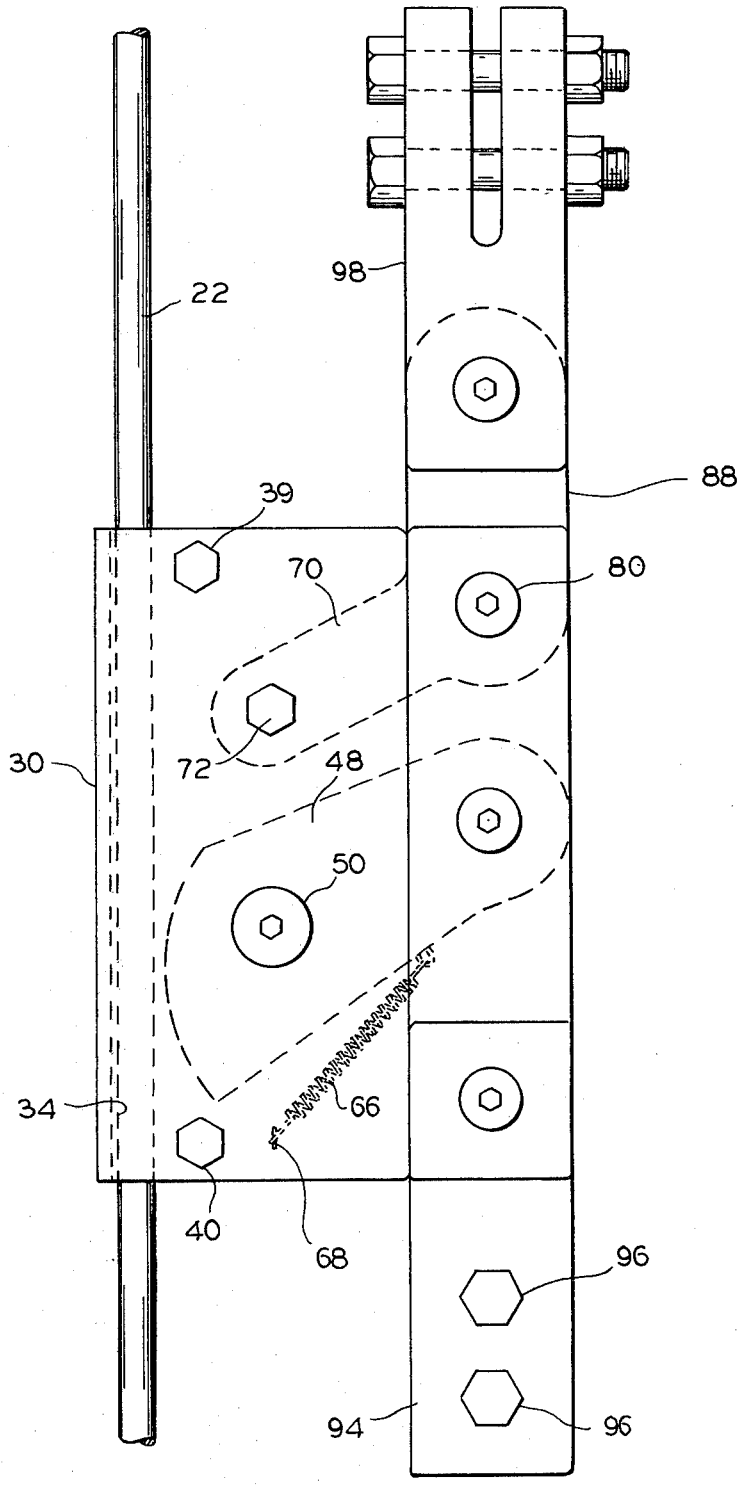
FIG. 5 is a side elevation of the platform safety device in the riding position and shows connecting linkages.

Lever arm member 48 includes a safety cable engaging portion 52 which in the release position shown in FIG. 5, confronts but does not engage the cable 22. Lever arm 48 includes an aperture therein, whereby a shouldered bolt or lever arm bar pivot member shown generally at 54 may be received for mounting the lever arm 48 between parallel elongate bar members 56 and 58. A bolt 60 is passed through an aperture of bar member 58, the aperture of lever arm 48, and a corresponding aperture of bar member 56. A washer 62 is placed on bolt 60 and a nut 64 is threaded onto the bolt. The lever arm 48 may thus rotate on the bolt 60 about an axis which is transverse to the direction of travel of the body member 30 on the safety cable 22.

A spring or bias member 66 is secured to lever arm 48 at one end and to the body member 30 at its other end via cotter pin 68 such that it is sandwiched between the sidewalls 36 and 38. The spring 66 has a predetermined tension which aids in urging the lever arm 48 to a position such that the cable engaging portion 52 will more quickly engage the cable 22 in response to equipment failure.

A linkage arm or linking member 70 is sandwiched between the sidewalls 31 and 32 and is pivotally connected to the upper portion of body member 30 by means of a pivot member 72. Pivot member 72 includes a bolt member 74 which passes through corresponding apertures in sidewalls 31 and 32 and in an end portion of linking member 70 and which is secured by a washer and a threaded nut. The linking member 70 may thereby rotate about an axis which is substantially transverse to the direction of travel of the body member 30 on the upright safety cable 22. The other end of linking member 70 is similarly pivotally connected to and sandwiched between the elongate bar members 56 and 58 by pivot means 80 comprising a bolt 82 which passes through apertures in elongate bar members 56 and 58 in linking arm 70 and which is secured by washer 84 and nut 86. A second linking arm or member 88 is integrally formed with the linking member 70 and includes an aperture 90 which permits a linkage to be bolted thereto for connecting the safety clamp device to a traction drive unit. The linking members 70 and 88 may be referred to as a modified bellcrank. It is particularly advantageous that the angle formed by the arms 70 and 88 be 90° or greater.

The safety clamp device may be assembled in an arrangement such as shown in FIG. 1. The elongate bar members 56 and 58 may be connected to a scaffold by means of a linkage 94 as shown in FIG. 5 which is pivotally connected to the elongate bar members 56 and 58 by a bolt 92 passed through apertures in the elongate bar members 56 and 58. The linkage 94 may be connected to platform support bars 14 by means of the bolts 96. The upper arm 88 of the bellcrank may be pivotally connected to a linkage 98 which in turn is connected to a motor drive unit by means of a bolt passed through aperture 90.

With the scaffold suspended beneath the safety device, the safety device is maintained in the position shown in FIG. 5. The tension between the upper end of the linking arm 88 and the lower end of elongate bar members 56 and 58 maintain the arm 88 in vertical alignment with the bar members. The lever arm 48 and the linking arm 70 pivot so as to maintain the elongate bar members 56 and 58 in parallel engagement with the edges 36 and 38 respectively of the sidewalls 31 and 32. In this position, the safety cable engaging portion 52 of the lever arm confronts but does not engage the cable 22. The body member 30 is maintained parallel to the safety cable 22 and thus will freely ride vertically along the safety cable 22.

Failure of the hoist line or traction drive unit results in the safety device taking a position similar to that shown in FIG. 2. In the absence of tension between the linking arm 88 and the lower portion of the elongate bar members 56 and 58, the bellcrank will pivot forcing the elongate bar members 56 and 58 to move downward relative to the body member 30 causing lever arm 48 to pivot such that the safety cable engaging portion 52 to contact and exert considerable pressure on safety cable 22 thereby wedging cable 22 against the cable receiving cradle 34 and preventing downward movement of the platform 12. Downward platform forces maintain the locking action as described above. It should be noted that the parallel elongate bars 56 and 58 no longer contact the edges 36 and 38.

By means of the pivotal actions of the lever arm 48 and arm 70 of the modified bellcrank 88, the elongate bars 56 and 58 are maintained in parallel relationship with the edges 36 and 38, respectively.

The safety clamp of the invention operates to immediately stop downward movement of the platform in the event there is hoist line failure or if there is failure of the traction drive unit. It should be noted that the immediate clamping action prevents any substantial downward movement of the movable platform before stopping occurs thereby preventing subsequent jar or jerking of the platform.

It will be understood that various changes may be made in the form, details, arrangement and proportions of the various parts without departing from the spirit and the scope of the invention.

What is claimed is:

1. A safety clamp device adapted to be slidably mounted on an upright safety cable and adapted to be connected to a means for raising and lowering a movable platform, said safety device comprising:

a body member having a cable receiving cradle adapted to receive said safety cable;

a lever arm shiftably mounted on said body member for movement about an axis transverse to the slidable movement of said body member relative to said safety cable, said lever arm shiftable between a safety cable engaging position and a safety cable release position;

safety cable engaging means for engaging said safety cable when said lever arm is in said engaging position;

at least one elongate bar member pivotally attached to said lever arm, said bar member positioned in a first upright position to maintain said lever arm in said release position, said bar member adapted to shift to a second upright position to urge said lever arm to said engaging position at the time of failure of said raising and lowering means;

means for coupling one end of said elongate bar member to said movable platform;

means for coupling the other end of said elongate bar member to said raising and lowering means; and a linkage arm pivotally connected at one end to said body member and pivotally connected at the other end to said bar member, said linkage arm and said lever arm cooperatively acting to maintain said cradle and said bar member in parallel relationship to said safety cable.

2. A safety clamp in accordance with claim 1, wherein said coupling means comprises a second linkage arm pivotally connected to said bar member at one end and coupled to said raising and lowering means at the other end.

3. A safety clamp in accordance with claim 2, wherein said first and second linkage arms are integrally formed as a modified bellcrank.

4. A safety clamp in accordance with claim 3, wherein said modified bellcrank maintains said bar member in said first upright position when a first predetermined vertical force is applied to said second arm and to urge said bar member to said second upright position when a second predetermined force is applied to said second arm.

5. A safety clamp in accordance with claim 1, 2 or 3, further including at least one cable guide member on said body member adapted to guide and retain said safety cable in said cradle.

6. A safety clamp in accordance with claim 1, 2 or 3, wherein said body member includes a pair of spaced apart sidewalls extending outwardly from said cradle whereby said safety cable may be positioned between said sidewalls to position said safety cable in said cradle.

7. A safety clamp in accordance with claim 6, wherein said lever arm is positioned between said sidewalls and is pivotally connected thereto.

8. A safety clamp in accordance with claim 7, wherein said sidewalls each include an upright bar engaging edge adapted to engage said bar member when said bar member is in said first upright position.

9. A safety clamp in accordance with claim 1, including a pair of parallel spaced apart elongate bar members pivotally attached to said lever arm and sandwiching said lever arm therebetween.

10. A safety clamp in accordance with claim 1, further comprising a bias means connected to said body member and said lever arm.

11. A safety clamp device adapted to be slidably mounted on an upright safety cable and adapted to be connected to a means for raising and lowering a movable platform, said safety device comprising:

a body member having a cable receiving cradle adapted to receive said safety cable;

a lever arm shiftably mounted on said body member for movement about an axis transverse to the slidable movement of said body member relative to said safety cable, said lever arm shiftable between a safety cable engaging position and a safety cable release position.

safety cable engaging means for engaging said safety cable when said lever arm is in said engaging position;

at least one elongate bar member pivotally attached to said lever arm, said bar member positioned in a first upright position to maintain said lever arm in said release position, said bar member adapted to shift to a second upright position to urge said lever arm to said engaging position at the time of failure of said raising and lowering means;

means for coupling one end of said elongate bar member to said movable platform;

means for coupling the other end of said elongate bar member to said raising and lowering means; and a modified bellcrank having a first arm pivotally connected to said body member and a second arm adapted to be pivotally coupled to said raising and lowering means, the apex of said bellcrank pivotally connected to said bar member, said modified bellcrank and said cradle cooperatively acting to maintain said cradle and said bar member in parallel relationship.

12. A safety clamp in accordance with claim 11, wherein said body member includes a pair of spaced apart sidewalls extending outwardly from said cradle whereby said safety cable may be positioned between said sidewalls to position said safety cable in said cradle, said lever arm is positioned between said sidewalls and pivotally connected thereto, said first arm is positioned between said sidewalls and pivotally connected thereto.

13. A safety clamp in accordance with claim 12, including a pair of parallel spaced apart elongate bar members pivotally attached to said lever arm and pivotally attached to the apex of said modified bellcrank and sandwiching said lever arm and said bellcrank therebetween.

14. A safety clamp in accordance with claim 13, further comprising at least one cable guide means to guide and retain the safety cable in said cradle.

15. Platform apparatus for ascending or descending a hoist cable and for engaging a safety cable to prevent sudden downward movement thereof, said apparatus comprising:

a movable platform;

a platform lifting device; and a safety clamp device slidably mounted on said safety cable and disposed between said platform and said lifting device, said safety clamp device comprising: a body member having a cable receiving cradle adapted to receive said safety cable;

a lever arm shiftably mounted on said body member for movement about an axis transverse to the slidable movement on said body member relative to said safety cable, said lever arm shiftable between a safety cable engaging position and a safety cable release position;

safety cable engaging means for engaging said safety cable when said lever arm is in said engaging position;

at least one elongate bar member pivotally attached to said lever arm, said bar member coupled at its lower end to said platform; and a first arm pivotally connected at one end to said body member and pivotally connected at the other end to the upper end of said bar member, said lever arm and said first arm cooperatively acting to maintain said cradle and said bar member in parallel relationship to said safety cable.

16. Platform apparatus in accordance with claim 15, further comprising:

a second arm pivotally connected at one end to said upper end of said bar member and coupled at the other end to said lifting device.

17. Platform apparatus in accordance with claim 16, wherein said one end of said second arm is pivotally connected to said lifting device.

18. Platform apparatus in accordance with claim 17, wherein said lifting device is a traction drive unit for ascending and descending a cable.

19. Platform apparatus for ascending or descending a hoist cable and for engaging a safety cable to prevent sudden downward movement thereof, said apparatus comprising:

a movable platform;

a platform lifting device; and a safety clamp device slidably mounted on said safety cable and disposed between said platform and said lifting device, said safety clamp device comprising: a body member having a cable receiving cradle adapted to receive said safety cable;

a lever arm shiftably mounted on said body member for movement about an axis transverse to the slidable movement of said body member relative to said safety cable, said lever arm shiftable between a safety cable engaging position and a safety cable release position;

safety cable engaging means for engaging said safety cable when said lever arm is in said engaging position;

at least one elongate bar member pivotally attached to said lower arm, said bar member coupled at its lower end to said platform; and a. modified bellcrank having a first arm pivotally connected to said body member, a second arm pivotally coupled to said lifting device, and the apex between said first and second arms pivotally connected to the upper end of said bar member, said modified bellcrank and said lever arm cooperatively acting to maintain said cradle and said bar member in parallel relationship to said safety cable.

20. Platform apparatus in accordance with claim 19, wherein said lifting device is a traction drive unit adapted to ascend and descend a hoist cable.

* * * * *